US010267251B2

(12) United States Patent
Schuele et al.

(10) Patent No.: US 10,267,251 B2
(45) Date of Patent: Apr. 23, 2019

(54) METHOD FOR MEASURING FRESH AIR BY EVALUATING AN INTERNAL CYLINDER PRESSURE SIGNAL

(71) Applicant: Continental Automotive GmbH, Hannover (DE)

(72) Inventors: Harry Schuele, Neunburg V. Wald (DE); Bjoern Knorr, Ruesselsheim (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 543 days.

(21) Appl. No.: 14/646,954

(22) PCT Filed: Oct. 30, 2013

(86) PCT No.: PCT/EP2013/072676
§ 371 (c)(1),
(2) Date: Oct. 5, 2015

(87) PCT Pub. No.: WO2014/079667
PCT Pub. Date: May 30, 2014

(65) Prior Publication Data

US 2016/0069289 A1 Mar. 10, 2016

(30) Foreign Application Priority Data

Nov. 22, 2012 (DE) ..... 10 2012 221 311

(51) Int. Cl.
*F02D 41/18* (2006.01)
*F02D 35/02* (2006.01)
*F02D 41/00* (2006.01)

(52) U.S. Cl.
CPC ..... *F02D 41/182* (2013.01); *F02D 35/023* (2013.01); *F02D 41/009* (2013.01); *F02D 2200/0402* (2013.01)

(58) Field of Classification Search
CPC .... F02D 41/182; F02D 35/023; F02D 41/009; F02D 2200/0402
(Continued)

(56) References Cited

U.S. PATENT DOCUMENTS 5,359,975 A * 11/1994 Katashiba ..... F02D 35/023 123/435
5,765,532 A * 6/1998 Loye ..... F02D 35/023 123/435
(Continued)

FOREIGN PATENT DOCUMENTS

CN 1181124 A 5/1998 ..... F02D 41/04
CN 1433504 A 7/2003 ..... F02D 41/18
(Continued)

OTHER PUBLICATIONS

Chinese Office Action, Application No. 201380061137.1, 5 pages, dated Nov. 2, 2016.
(Continued)

*Primary Examiner* — David E Hamaoui
*Assistant Examiner* — Susan E Scharpf
(74) *Attorney, Agent, or Firm* — Slayden Grubert Beard PLLC

(57) ABSTRACT

A method for determining an air mass air in a cylinder of an internal combustion engine is disclosed. A first filling equivalent is determined during a compression phase of the cylinder, wherein the first filling equivalent corresponds to a first average pressure difference in a first angle range of a crank angle in the compression phase. A second filling equivalent is determined during an expansion phase of the cylinder, wherein the second filling equivalent corresponds to a second average pressure difference in a second angle range of the crank angle of the expansion phase. A differential filling equivalent is calculated by subtracting the first
(Continued)

filling equivalent from the second filling equivalent. The air mass in the cylinder is determined based on the differential filling equivalent.

12 Claims, 3 Drawing Sheets

(58) Field of Classification Search
USPC ..... 701/103; 123/674–675
See application file for complete search history.

(56) References Cited

U.S. PATENT DOCUMENTS 5,889,205 A * 3/1999 Treinies ..... F02D 41/1401 73/114.32
6,167,755 B1 * 1/2001 Damson ..... F02D 35/023 73/114.13
6,889,664 B2 * 5/2005 Worth ..... F02D 41/18 123/494
7,025,041 B2 * 4/2006 Abe ..... F02D 35/024 123/432
2008/0195294 A1 * 8/2008 Moriya ..... F02D 35/023 701/103
2010/0004845 A1 * 1/2010 Tunestal ..... F02D 35/023 701/102
2011/0040475 A1 * 2/2011 Taibi ..... F02D 35/023 701/105

FOREIGN PATENT DOCUMENTS

CN 1657755 A 8/2005 ..... F02D 41/14
DE 4443517 A1 6/1995 ..... F02D 35/02
EP 1662121 A1 5/2006 ..... F02D 41/00

OTHER PUBLICATIONS

Jippa, Kai-Nicolas, "Online-Capable Thermodynamics-Based Approaches for the Assessment of Cylinder Pressure Dynamics", ISBN 3-8169-2306-2, pp. 18-39 (15 pages total) (German language w/ English abstract), Feb. 2002.
International Search Report and Written Opinion, Application No. PCT/EP2013/072676, 23 pages, dated Feb. 17, 2014.

* cited by examiner

METHOD FOR MEASURING FRESH AIR BY EVALUATING AN INTERNAL CYLINDER PRESSURE SIGNAL

CROSS-REFERENCE TO RELATED APPLICATIONS

This application is a U.S. National Stage Application of International Application No. PCT/EP2013/072676 filed Oct. 30, 2013, which designates the United States of America, and claims priority to DE Application No. 10 2012 221 311.2 filed Nov. 22, 2012, the contents of which are hereby incorporated by reference in their entirety.

TECHNICAL FIELD

The present invention relates to a method for determining an air mass in a cylinder of an internal combustion engine. In addition, the present invention relates to a method for operating an internal combustion engine and to a control device for an internal combustion engine.

BACKGROUND

There is a desire to improve internal combustion engines which are operated with fossil fuels to the effect that the limiting values for emissions and the fuel consumption are reduced. As a result, the mechanical design of an internal combustion engine is becoming ever more complex. In particular, the efficiency of the internal combustion engine can be improved by the way in which the air mass is fed into a cylinder. Depending on the design of the engine, for example complex camshaft adjustment systems for adjusting the stroke and the phase of the inlet and outlet valves can be controlled in such a way that filling losses of the cylinders are reduced. For example, inlet and outlet valves of various cylinders can also be actuated differently.

In the field of engine control, the filling of the cylinders with fresh air is usually determined by modeling an intake section, i.e. by means of what is referred to as a container model. The calculation of the quantity of fuel to be injected is carried out for all the cylinders in the same way with a model-based value. Differences between the individual cylinders can be taken into account here only at high cost. In particular, in the case of rapid load changes, during which the filling changes markedly from one working cycle to the other or during the active adjustment of the camshaft phase or the valve stroke, the correction requires very complex functions and calibration of the characteristic diagrams. Owing to the mechanical design of the intake section and a multiplicity of variables in the valve drive, in particular in the case of the valve stroke adjustment systems, which adjust continuously and in some cases on a cylinder-specific basis, differences can come about between specific cylinders during the taking in of fresh air. For example, this can also be caused by pulsation in the intake manifold. In this context, in particular mechanical component tolerances are an influencing factor in series fabrication and can lead to fresh air supply faults of the individual cylinders, and cannot be excluded even with the best application.

The large variability of the individual valves also leads to a situation in which in the case of dynamic changes in load the sucked-in air mass in the cylinders or the air mass in the cylinders which is blown in by the turbocharger can be increasingly difficult to determine with the model mentioned above.

For example, it is also possible to use calculation models which are based on measurement data of intake manifold pressure sensors, air mass meters, temperature sensors or lambda probe measured values. For example, the filling in a cylinder, composed of fresh air, residual gas and fuel according to Jippa can be determined by means of a filling equivalent, wherein the filling equivalent is determined based on a cylinder pressure during a compression phase of the cylinder. The total gas mass located in the cylinder can be inferred from the filling equivalent by using, in addition to the cylinder pressure profile, various further characteristic parameters such as, for example, the engine rotational speed, the air ratio, the coolant temperature, the ambient temperature and the ambient pressure (Jippa, Kai-Nicolas: "Online-capable, thermodynamic approaches for evaluating cylinder pressure profiles", dissertation, University of Stuttgart, 2002)

For this measurement of fresh air in a cylinder using the measurement of the filling and using the filling equivalent, complex models are necessary, inter alia owing to the multiplicity of required parameters, said models resulting in an extremely complex engine control system. Furthermore, a multiplicity of additional sensors are necessary.

SUMMARY

One embodiment provides a method for determining an air mass in a cylinder of an internal combustion engine, wherein the method comprises determining a first filling equivalent during a compression phase of the cylinder, wherein the first filling equivalent corresponds to a first average pressure difference in a first angle range of a crank angle in the compression phase, determining a second filling equivalent during an expansion phase of the cylinder, wherein the second filling equivalent corresponds to a second average pressure difference in a second angle range of the crank angle of the expansion phase, forming a differential filling equivalent by means of subtraction of the first filling equivalent from the second filling equivalent, and determining the air mass in the cylinder based on the differential filling equivalent.

In a further embodiment, the first angle range has a first angle interval from an ignition top dead center of the crank angle, wherein the second angle range has a second angle interval from the ignition top dead center of the crank angle, and wherein the first angle interval is of the same size as the second angle interval.

In a further embodiment, the first angle range is of the same size as the second angle range.

In a further embodiment, in the first angle range an inlet valve of the cylinder is closed.

In a further embodiment, the method further comprises determining a percentage combustion proportion of a complete combustion of a fuel in the cylinder at the start of the second angle range of the expansion phase, determining a correction factor which is indicative of the percentage combustion proportion, wherein the determination of the second filling equivalent comprises determining an uncorrected, second filling equivalent, and determining the second filling equivalent based on the formula:

$$FA_{exp} = \frac{FA_{uncor,exp}}{1 - f}$$

where $FA_{exp}$=second filling equivalent, $FA_{uncor,exp}$=uncorrected, second filling equivalent, and f=correction factor.

Another embodiment provides a method for operating an internal combustion engine, the method comprising performing a method as disclosed above, and setting a fuel/air mixture of the internal combustion engine based on the determined air mass in the cylinder of the internal combustion engine.

Another embodiment provides a control device for an internal combustion engine of a motor vehicle, wherein the control device is configured to perform a method as disclosed above.

Another embodiment provides a computer program for determining an air mass in a cylinder of an internal combustion engine, which program, when executed by a processor, is configured to perform a method as disclosed above.

BRIEF DESCRIPTION OF THE DRAWINGS

Example embodiments are described in more detail below with reference to the appended figures, in which.

DETAILED DESCRIPTION

Figure 1:
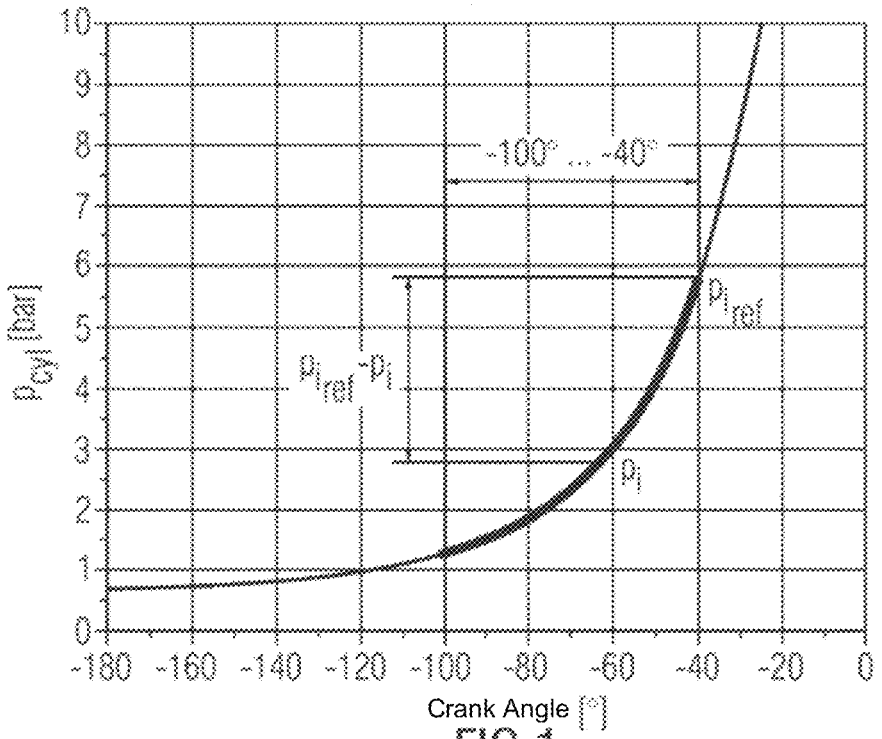
FIG. 1 shows a diagram in which a pressure profile is shown plotted against a crank angle in the compression phase, according to an example embodiment.

Embodiments of the present invention provide a simple method for determining an air mass in a cylinder of an internal combustion engine.

More particularly, embodiments provide a method for determining an air mass in a cylinder of an internal combustion engine, a method for operating an internal combustion engine, and a control device for an internal combustion engine.

Some embodiments provide a method for determining an air mass in a cylinder (i.e. a combustion chamber of the cylinder) of an internal combustion engine, in particular of an internal combustion engine for a motor vehicle. According to the method, a first filling equivalent is determined during a compression phase of the cylinder. The first filling equivalent corresponds to a first average pressure difference in a first angle range of a crank angle in the compression phase.

In addition, a second filling equivalent is determined during an expansion phase of the cylinder. The second filling equivalent corresponds to a second average pressure difference in a second angle range of the crank angle of the internal combustion engine in the expansion phase.

A differential filling equivalent is formed by means of subtraction of the first filling equivalent from the second filling equivalent. The air mass in the cylinder is determined based on the differential filling equivalent. The differential filling equivalent is indicative of the air mass in the cylinder, with the result that the air mass in the cylinder can be determined based on the differential filling equivalent.

Other embodiments provide a method for operating an internal combustion engine is described, wherein firstly the above-described method for determining an air mass in a cylinder will be carried out. Based on the determined air mass in the cylinder of the internal combustion engine, a fuel/air mixture in the internal combustion engine is set, for example in an intake stroke in the case of intake-manifold-injecting internal combustion engines or directly in the cylinder in the case of direct-injecting internal combustion engines.

Arranged in the cylinder of the internal combustion engine is a piston which is coupled to the crank shaft. The position of the cylinder piston in the cylinder is predefined in accordance with the position of the crank shaft along the circumferential direction thereof. One rotation of the crank shaft describes a crank shaft interval of 360° crank angle. The position of the crank angle along its circumferential direction is specified by means of the crank angle. In an exemplary scaling at a 0° position the cylinder is, for example, at a top dead center. The top dead center is also referred to as the ignition top dead center (ignition TDC).

The ignition TDC is a position at which the piston is at the highest and the cylinder volume is minimal. The ignition TDC is that top dead center which separates the compression stroke from the expansion stroke. It is given the designation ignition TDC because the ignition occurs in the vicinity thereof.

If the crank angle has, for example ±180°, the piston is at a bottom dead center.

In other words, the differentiation is made between the top dead center (TDC) (the upper side of the piston is located near to the cylinder head) and the bottom dead center (BDC) (the upper side of the piston is remote from the cylinder head. The top dead center serves as an example as a reference for the crank shaft position. A crank shaft position of 0° can be defined as the ignition TDC.

The compression phase is located, for example, in an angle range of the crank angle between −180° and 0°. In the angle range between −180° and 0° of the crank angle, the crank shaft turns in such a way that the piston is moved from the bottom dead center to the top dead center. As a result the volume in the cylinder is reduced and compression work is performed.

The expansion phase is defined in an angle range from 0° to 180° of the crank angle. In the expansion phase, the crank shaft turns in such a way that the piston moves from the ignition top dead center to the bottom dead center.

At the start of the compression phase, the inlet valves of the cylinder can still be opened as a function of the crank shaft adjustment system, with the result that fresh air, fuel and/or a fuel/air mixture is fed in. After a certain profile of the crank angle, the inlet valves are closed and the gas in the cylinder is compressed, with the result that compression work is performed. As a general rule, the fuel/air mixture is still ignited in the compression phase before the ignition top dead center.

In the expansion phase, the gas mixture in the cylinder presses the piston in the direction of the bottom dead center.

After a certain profile of the crank angle in the expansion phase, the outlet valves are opened, with the result that the burnt gas can escape from the cylinder. The outlet valve is usually opened after the entire gas mixture has been burnt. In many operating states, for example after a cold start of the engine, the fuel/air mixture is ignited late in such a way that when the outlet valves are opened only 90% of the gas mixture in the cylinder is burnt, and 10% is only burnt in subsequent regions, for example in the exhaust gas region or at the catalytic converter of a motor vehicle, in order to generate a combustion temperature there.

Air can be understood to be fresh air or ambient air. In the gas volume of the combustion chamber of the cylinder there is a gas mixture in the expansion phase which contains a certain air mass, a certain quantity of fuel and a certain residual quantity of gas. The air mass is composed of ambient air such as, for example, of 21% oxygen and 79% nitrogen. The quantity of fuel is composed of the fed-in fuel in the cylinder. The residual quantity of gas is composed of inert gas components such as, for example, carbon monoxide, carbon dioxide nitrogen oxides, etc. which are still located in the cylinder volume owing to a preceding combustion process. An object of the present invention is to determine the air mass in a cylinder of the internal combustion engine.

Aspects of the invention are based on the realization that a cylinder pressure depends on released combustion heat. In an internal combustion engine, in particular in a spark ignition engine, the released combustion heat is in turn dependent on the air mass located in the gas mixture of the cylinder, by way of the combustion/air ratio. There is a direct relationship between the cylinder pressure and an air mass in the cylinder.

In other words, by correspondingly evaluating the pressure profile of the compression phase and evaluating the pressure profile in the expansion phase it is possible to determine the released combustion heat and therefore in turn the air mass located in the cylinder. The air mass which is determined with the present method is that mass of fresh air which is located in the cylinder after the closing of the inlet valve.

By comparing the pressure profiles in the compression phase and the expansion phase it is possible to infer the released combustion heat. In order to obtain the released combustion heat, a first filling equivalent during a compression phase is compared with a second filling equivalent during an expansion phase of the cylinder. Firstly the first filling equivalent is determined during the compression phase and the second filling equivalent is determined during the expansion phase.

The first filling equivalent during the compression phase specifies an average pressure difference in a first angle range of a crank angle in the compression phase. The first angle range is a region within a range of the crank angle between −180° and 0°. The first filling equivalent can be determined by means of the following formula:

$$\Delta\overline{p}_{comp} = \frac{1}{n}\sum_{i=i,ref-n}^{i,ref-1}(p_{i,ref} - p_i) = FA_{comp}$$

Firstly, a first angle range of the crank angle is determined in the compression phase. The first angle range should begin when the inlet valve is already closed and compression work is performed by the cylinder. The end of the first angle range should also be at a certain distance from the ignition time so that the combustion has not yet been initiated and heat has not yet been released.

The reference pressure $p_{i,ref}$ is usually defined at the start or at the end of the first angle range and measured by means of a pressure sensor (see FIG. 1).

In the first angle range, a certain number n of pressure measurements $p_i$ is performed at certain crank angles within the first angle range. The pressure measurements correspond to relative pressure measurements at a certain crank angle within the first angle range. The pressure measurements are each subtracted from the reference pressure, and the difference values are summed. Subsequently, the summed total differential pressure is divided by the number of measurements in order therefore to obtain the first average pressure difference $\Delta\overline{p}_{comp}$ in the first angle range. The first average pressure difference in the first angle range corresponds to the first filling equivalent $FA_{comp}$. The values of the first filling equivalent in the compression phase are virtually directly proportional to a compression work which is in turn directly proportional to a total gas mass in the cylinder given a constant rotational speed and intake air temperature.

Subsequently, the second filling equivalent is determined during a second angle range of the crank angle in an expansion phase of the cylinder. The second filling equivalent corresponds to a second average pressure difference in a second angle range of the crank angle of the expansion phase. The second filling equivalent can be calculated with the following formula $$\Delta\overline{p}_{exp} = \frac{1}{n}\sum_{i=1+i,ref}^{n+i,ref}(p_{i,ref} - p_i) = FA_{exp}$$

The second angle range should be selected with a certain distance (crank angle interval) after the ignition TDC and should start when the combustion has already ended completely or has progressed far and therefore the maximum combustion heat has been released. In addition, the outlet valve should still be closed at the end of the second angle range.

The reference pressure $p_{i,ref}$ is usually defined at the start or at the end of the second angle range and is measured by means of a pressure sensor.

In the second angle range, a certain number n of pressure measurements $p_i$ is performed at certain crank angles within the second angle range. The pressure measurements correspond to relative pressure measurements at a specific crank angle within the second angle range. The pressure measurements are each subtracted from the reference pressure and the difference values are summed. The summed total differential pressure is then divided by the number of measurements in order therefore to obtain the second average pressure difference $\Delta\overline{p}_{exp}$ in the second angle range. The second average pressure difference in the second angle range corresponds to the second filling equivalent $FA_{exp}$.

The cylinder pressure in the second angle range is dependent on the total gas mass and the released combustion heat in the cylinder. As mentioned at the beginning, the released combustion heat is in turn dependent on the air mass which is located in the cylinder and was available for the combustion. In order to infer the air mass in the cylinder, the first filling equivalent of the compression phase is subtracted from the second filling equivalent of the expansion phase, and a differential filling equivalent is formed:

$$FA_{diff}=FA_{exp}-FA_{comp}$$

The differential filling equivalent therefore describes the air mass which has been burnt in the expansion phase. As a result, for example the influence of the residual gas mass which does not contribute to the combustion is also reduced, since the residual gas is both compressed and expanded, and therefore removed from the calculations by the formation of differences.

Each differential filling equivalent therefore stands for a specific air mass component or for a specific air mass in the cylinder. The differential filling equivalent is therefore indicative of released combustion heat which is in turn indicative of the air mass in the cylinder. The assignment of the air mass to a specific differential filling equivalent is specific to each design series of an internal combustion engine and can be determined, for example, once empirically by means of laboratory trials of the internal combustion engine. The data record of the air mass in relation to the differential filling equivalent can be made available, for example, to the engine controller of the internal combustion engine in order therefore to achieve improved engine control and/or determination of the air mass and therefore determination of the fuel.

It is possible to provide that the air mass in the cylinder is determined based on the differential filling equivalent by means of a predefined relationship between these variables. This relationship can be determined, for example, empirically or by means of a model and, in particular, defined. The relationship can be specific to the engine type or for engine specifications. The relationship can be specific to a desired driving style or to an engine behavior for example to an economical driving style or to a sporty driving style or generally to driving styles which have different performance characteristic curves, driving behaviors or reaction behaviors of the internal combustion engine. The relationship can be given by a characteristic curve or by a characteristic curve diagram or by a function or by parameters of a function which represent the relationship for a plurality of different differential filling equivalents or air masses. The function or the characteristic curve preferably forms a behavior which is monotonous or strictly monotonous, preferably continuous at least in certain sections, and represents the relationship between the differential filling equivalent and air masses. The relationship can be represented by a multiplicity of air mass values or value intervals thereof which are each assigned to at least one differential filling equivalent value or at least one value interval thereof. The relationship can be provided according to an assignment presented here. The relationship can be provided as a look-up table which is stored, in particular, in a memory of the control device described here.

According to a further embodiment, the first angle range has a first angle interval from an ignition top dead center (ignition TDC) of the crank angle. The second angle range has a second angle interval from the ignition top dead center of the crank angle. The first angle interval is of the same size as the second angle interval here.

With this embodiment, an end of the first angle range which is close to the ignition TDC has the same angle interval from the ignition TDC as a start of the second angle range which is near to the ignition TDC. By way of example, the first angle range ends at −40° crank angle and the second angle range starts at +40° crank angle.

In a further embodiment, the first angle range is of the same size as the second angle range. For example, the first angle range is between a crank angle of approximately −120° and a crank angle of approximately −20°, in particular between a crank angle of approximately −100° up to a crank angle of approximately −40°. Correspondingly, the second range can be between a crank angle of approximately 20° up to a crank angle of approximately 120°, in particular between a crank angle of approximately 40° and a crank angle of approximately 100°.

In other words, the first angle range can have the same crank angle interval from the ignition TDC and the same width or same size as the second angle range. If the first angle range is at the same interval from the ignition TDC as the second angle range in the expansion phase and if the first angle range is of the same size as the second angle range, the changes in pressure or their pressure profiles plotted against the crank angle in the compression phase are virtually symmetrical to those in the expansion phase with the result that better comparison values can be used to form the differential filling equivalent.

According to a further exemplary embodiment, the first angle range is in a crank angle range in which an inlet valve of the cylinder is closed. The change in pressure in the course of the crank angle range in the first angle range is therefore not falsified by possible deviations as a result of an opened inlet valve.

According to a further embodiment, at the start of the second angle range of the expansion phase a percentage combustion proportion is determined compared to fully complete combustion of a fuel with the air mass in the cylinder. In addition, a correction factor is determined which is indicative of the percentage combustion proportion.

The determination of the second filling equivalent also comprises determining an uncorrected, second filling equivalent. The uncorrected, second filling equivalent corresponds, for example, to the second average pressure difference in the second angle range of the crank angle, wherein the uncorrected, second filling equivalent is calculated by means of the above-mentioned formula for the second filling equivalent. However, the pressure measured values used for the calculation have been measured in a state in which the combustion has not yet completely finished. The uncorrected, second filling equivalent therefore constitutes the second average pressure difference in the second angle range even though the combustion of the fuel and the generation of heat in the cylinder during the expansion phase has not yet completely ended.

In order to correct this uncorrected, second filling equivalent, a second reference filling equivalent, which corresponds to the second filling equivalent, is subsequently determined based on the following formula:

$$FA_{exp,Ref} = \frac{FA_{uncor,exp}}{1-f}$$

where:

$FA_{exp,Ref}$=second reference filling equivalent, $FA_{uncor,exp}$=uncorrected, second filling equivalent, and f=correction factor.

The degree of combustion of a fuel in the cylinder during the expansion phase is described, for example, with what is referred to as a cumulative heating profile. The cumulative heating profile indicates a quantity of heat which is produced when the fuel is burnt completely with the air mass in an expansion phase, i.e. when 100% of the combustion in the cylinder has taken place. Since the quantity of heat depends decisively on how much air reacts with the fuel, the quantity of heat or the release of heat in the expansion phase is, as explained at the beginning, indicative of the air mass in the cylinder. The second filling equivalent, which is based on various pressure values in the second angle range of the crank angle of the expansion phase, is in turn dependent on the quantity of heat which is produced during combustion in the cylinder in the expansion phase. If the combustion of the fuel is not yet completely finished at the start of or during the second angle range, a smaller quantity of heat and correspondingly different pressures than in the case of complete combustion of the fuel are produced, with the result that the air mass cannot be determined 100% correctly.

In the event of the combustion not yet being completely finished at the start of the second angle range, the correction factor f described above is used. By means of the heating profile as a function of the crank angle in the expansion phase of the cylinder it is firstly possible to determine what percentage of the complete combustion has taken place at the start of the second angle range. This corresponds to the percentage combustion proportion.

For example, the complete combustion, i.e. the cumulative heating profile, can be standardized to 1 or 100%, wherein in the case of a certain operating state of the internal combustion engine at the start of the second angle range the percentage combustion proportion corresponds only to 0.9 or 90% of the complete combustion (corresponds to 90% of the quantity of heat).

The cumulative heating profile $Q_H$ of a combustion process in the cylinder can be calculated, for example, according to a calculation by Rassweiler/Withrow by means of the following formula:

$$Q_H = \int \Delta Q_H d\Phi$$

The heating profile $\Delta Q_H$ as a function of the crank angle corresponds to a derivation of the cumulative heating profile and can be calculated with the following formula:

$$\Delta Q_H = \frac{1}{\kappa - 1} \cdot V_{\Phi(i)} \cdot \left( p_{\Phi(i)} - p_{\Phi(i-1)} \cdot \left( \frac{V_{\Phi(i)-1}}{V_{\Phi(i)}} \right)^n \right)$$

for the heating profile as a function of the crank angle where n=polytropic exponent (for example 1.32), κ=isotropic exponent, and ϕ(i)=crank angle position A specific correction factor f is assigned to each value of an incomplete percentage combustion proportion. For example, the correction factor f=0.15 in the case of 90% combustion proportion (see FIG. 5 below). The respective assignment of the values of the correction factor f (Y axis in FIG. 5) to individual combustion proportions of a combustion process in the cylinder (X axis in FIG. 5) can be determined empirically for each internal combustion engine and corresponding operating state.

The uncorrected, second filling equivalent, which is based on corresponding pressure measurements which were present when an incomplete combustion process occurred, is now corrected by means of the correction factor.

A correction of the uncorrected, second filling equivalent is carried out in accordance with the abovementioned formula for the second reference filling equivalent.

By means of the second reference filling equivalent it is possible to form therefrom a corrected differential filling equivalent which corresponds to the pressure values in the case of a complete combustion process and therefore corresponds to an actual air mass in the cylinder. Therefore, a corrected statement about the air mass in the cylinder can be made even if a combustion process of the fuel in the second angle range is not yet completely ended.

Other embodiments provide a control device for an internal combustion engine of a motor vehicle, wherein the control device is configured in such a way that the method described above for determining an air mass in a cylinder of an internal combustion engine and/or the method described above for operating an internal combustion engine can be executed.

The control device can have, for example, a programmable process. In addition, the control unit can have a data base in which, for example, data for the empirically determined ratios between the differential filling equivalents and the corresponding air masses therefrom in the cylinder, data for first and second angle ranges of the crank angle and/or data for the ratios of the correction factors at specific crank angles, in specific operating states of the internal combustion engine and/or in combustion states in the expansion phase are stored. These data can be called, for example, by the processor. In addition, the control coordinates of the throttle valve or of the ignition times of the internal combustion engine can be stored in the database as parameters. In addition, the control unit can automatically initiate the method described above.

Other embodiments provide a computer program for determining an air mass in a cylinder of an internal combustion engine. The computer program is stored in non-transitory computer-readable media and executable by a processor to perform a method according to any of the embodiments described above.

According to this document, the designation of such a computer program is equivalent to the concept of a program element, of a computer program product and/or of a computer-readable medium which contains instructions for controlling a computer system in order to suitably coordinate the method of operation of a system or of a method, in order to achieve the effects which are linked to the method.

The computer program can be implemented as a computer-readable instruction code in any suitable programming language such as, for example, in JAVA, C++, etc. The computer program can be stored on a computer-readable storage medium (CD-Rom, DVD, Blu-ray disk, removable drive, volatile or non-volatile memory, installed memory/processor, etc.). The instruction code can program a computer or other programmable devices such as, in particular, a control unit or the control device described above for an internal combustion engine of a motor vehicle in such a way that the desired functions are executed. In addition, the computer program can be made available in a network such as, for example, the Internet, from which it can be downloaded when necessary by a user.

Embodiments can be implemented either by means of a computer program, i.e., software, or by means of one or more special electrical circuits, i.e., in the form of hardware or in any desired hybrid form, i.e., by means of software components and hardware components.

With the method described above it is therefore possible to determine the fresh air mass in the cylinder even in the case of engines with complex valve variations based on measured cylinder pressure signals, without relatively high expenditure on computing and on calibration being necessary. The method described above can therefore also be implemented in a simple way in an engine controller. Since the driving can be determined for any crank shaft passage in a cylinder, the fresh air mass can be determined dynamically even in the case of a transient engine operating mode. In addition, the above method can also be used in internal combustion engines with complex valve adjustment systems owing to the simple calculation and the exclusive use of the cylinder pressure signals.

The cylinder pressure in the second angle range in the expansion phase depends on the combustion heat released. In an internal combustion engine, in particular in a spark ignition engine, this is in turn dependent on the quality control of the fresh air mass located in the cylinder. In order to obtain better correlation with the converted combustion energy, a corresponding evaluation of the compression phase (first filling equivalent) is subtracted from the evaluation of the expansion phase (second filling equivalent). As a result, the influence of residual gas is also reduced since the residual gas is both compressed in the compression phase and expanded in the expansion phase and therefore drops out of the calculation as a result of the subtraction of the two filling equivalents. Although the residual gas is warmer during the expansion in the expansion phase and as a result gives rise to more pressure than in the compression phase, this heat of the residual gas is fed in through the combustion, which depends in turn on the converted air mass. The influence of the heating of the residual gas therefore likewise plays no role in the calculation of the air mass.

It is to be noted that the embodiments described here merely constitute a restricted selection of possible embodiment variants of the invention. It is therefore possible to combine the features of individual embodiments suitably with one another, with the result for a person skilled in the art that the embodiment variants which are explicit here are to be considered to constitute a public disclosure of a multiplicity of different embodiments.

FIG. 1 shows the pressure profile of a total gas mass $m_{Cyl}$ in a cylinder of an internal combustion engine during a compression phase. The crank angle between −180° and 0° is specified on the X axis. A portion of the intake phase and the compression phase of the cylinder are present between −180° and 0° crank angle. For example, up to a crank angle of 110° a gas mixture such as, for example, air and/or fuel is sucked in and the inlet valve is closed from 110°. Subsequently, the compression work starts between 110° crank angle and 0° crank angle, wherein a piston in the cylinder compresses the total gas mass $m_{Cyl}$ in the cylinder.

In the example in FIG. 1 a first angle range of the crank angle is determined in the compression phase between approximately −100° and −40°. In the first range, a first average pressure difference $\Delta\bar{p}_{comp}$ comp is calculated by means of the following formula:

$$\Delta\bar{p}_{comp} = \frac{1}{n}\sum_{i=i,ref-n}^{i,ref-1}(p_{i,ref} - p_i) = FA_{comp}$$

This first average pressure difference $\Delta\bar{p}_{comp}$ corresponds to a first filling equivalent $FA_{comp}$ in the compression phase of the cylinder.

The reference pressure $p_{i,ref}$ is measured at one end of the first angle range by means of a pressure sensor. In the present example, the reference pressure $p_{i,ref}$ is measured at the end of the first angle range which is closest to the ignition TDC (=0° crank angle).

The first angle range is also selected in such a way that the inlet valve is already closed at the end of the first angle range which is furthest away in relation to the ignition TDC (in the present example at −100° crank angle), and the compression work is already performed by the piston.

The first average pressure difference $\Delta\bar{p}_{comp}$ in the first angle range describes, as it were, an average change in pressure of the pressure profile. Owing to the formation of the average value offset corrections can be disregarded.

The first average pressure difference $\Delta\bar{p}_{comp}$ corresponds to the first filling equivalent $FA_{comp}$. The filling equivalent $FA_{comp}$ is (for example directly) proportional to compression work.

Figure 2:
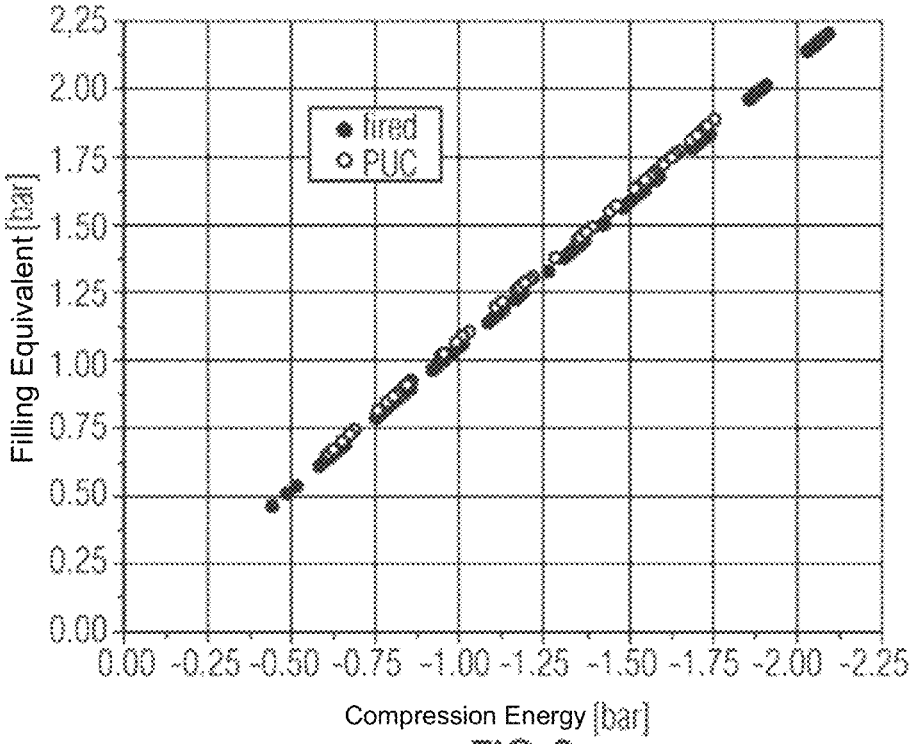
FIG. 2 shows a diagram in which a first filling equivalent is shown plotted against the compression work in the compression phase, according to an example embodiment.

FIG. 2 shows, for example, that the filling equivalent $FA_{comp}$ is proportional to the compression work. In the diagram in FIG. 2, the first filling equivalent $FA_{comp}$ is illustrated plotted against the compression work wherein the values for an operated or fired engine and the values for an engine which is not fired and is being towed (PUC) are illustrated and are correspondingly proportional. The compression work is in addition directly proportional to a total gas mass $m_{cyl}$ in the cylinder. The first guide equivalent $FA_{comp}$ is therefore likewise proportional to the total gas mass $m_{cyl}$ in the cylinder.

The total gas mass in the cylinder $m_{cyl}$ is composed of the residual gas mass $m_{AGR}$, the fuel mass $m_{fuel}$ and the air mass $m_{air}$:

$$m_{cyl} = m_{air} + m_{fuel} + m_{AGR}$$

The residual gas mass $m_{AGR}$ is composed, for example, of inert gas components which have remained in the cylinder from a preceding combustion process. The fuel mass $m_{fuel}$ is the proportion of the total gas mass $m_{cyl}$ which is made up of the fuel. The air mass $m_{air}$ is the air mass which is present in the cylinder at the ignition TDC. The air mass $m_{air}$ will now be determined below.

Figure 3:
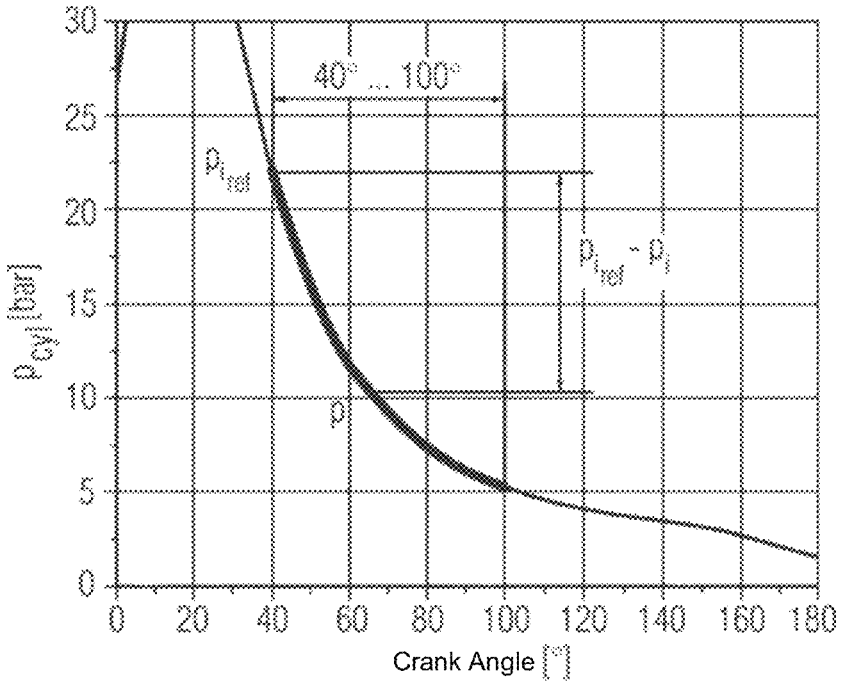
FIG. 3 shows a diagram in which a pressure profile is shown plotted against a crank angle in the expansion phase, according to an example embodiment.

FIG. 3 shows the pressure profile of the pressure in the cylinder plotted against the crank angle in an expansion phase of the cylinder.

A second filling equivalent $FA_{exp}$ is determined during the expansion phase of the cylinder, wherein the second filling equivalent $FA_{exp}$ corresponds to a second average pressure difference $\Delta\bar{p}_{exp}$ in a second angle range of the crank angle of the expansion phase. The second angle range is determined in the example from FIG. 3 between a crank angle of 40° and of 100°. At the crank angle between 0° and 180° the combustion of the fuel takes place and the expulsion of the exhaust gases starts.

The second average pressure difference $\Delta\bar{p}_{exp}$ in the second angle range of the crank angle of the expansion phase is calculated, for example, by means of the following formula:

$$\Delta\bar{p}_{exp} = \frac{1}{n}\sum_{i=1+i,ref}^{n+i,ref}(p_{i,ref} - p_i) = FA_{exp}$$

The pressure which is present at an end of the second angle range is measured as a reference pressure $p_{i,ref}$ in the expansion phase. In the present example, the reference pressure $p_{i,ref}$ at the end of the second angle range is selected this end being closest to the ignition TDC.

A comparison between FIG. 1 and FIG. 3 shows that the pressure level in the expansion phase is significantly higher than in the compression phase. This is due to the fact that in the expansion phase the gas mixture burns and becomes hot. The cylinder pressure in the expansion phase depends not only on the total gas mass $m_{cyl}$ but also on the released combustion heat. The values of the first filling equivalent $FA_{comp}$, of the second filling equivalent $FA_{exp}$ and therefore of the differential filling equivalent $FA_{diff}$ are dependent on the operating state of the internal combustion engine. This means, for example, that in the case of a full-load operating mode a higher pressure level is generated in the expansion phase in the cylinder than, for example, in the idling mode.

A comparison of the cylinder pressures in the compression phase and the expansion phase provides a specific amount of released combustion heat, which depends in turn on the air mass.

This correlation between the pressure level in the compression phase and in the expansion phase is described by means of a differential filling equivalent $FA_{diff}$. The differential filling equivalent $FA_{diff}$ is determined by means of subtraction of the first filling equivalent $FA_{comp}$ from the second filling equivalent $FA_{exp}$:

$$FA_{diff}=FA_{exp}-FA_{comp}$$

In one advantageous embodiment, the first angle range and the second angle range can be selected with the same interval from the ignition TDC. In addition, the first and second angle ranges can be selected to be of equal size. This makes the pressure profile in the first angle range and the pressure profile in the second angle range almost symmetrical (see comparison of FIG. 1 and FIG. 3). In the exemplary embodiment in FIG. 1 and FIG. 3 it is apparent, for example, that the first angle range in the compression phase has a 40° crank angle interval from the ignition TDC and the second angle range also has a 40° crank angle interval in the expansion phase. The first angle range and the second angle range extend over 60° crank angle (−100° to −40° in the compression phase and 40° to 100° in the expansion phase).

Figure 4:
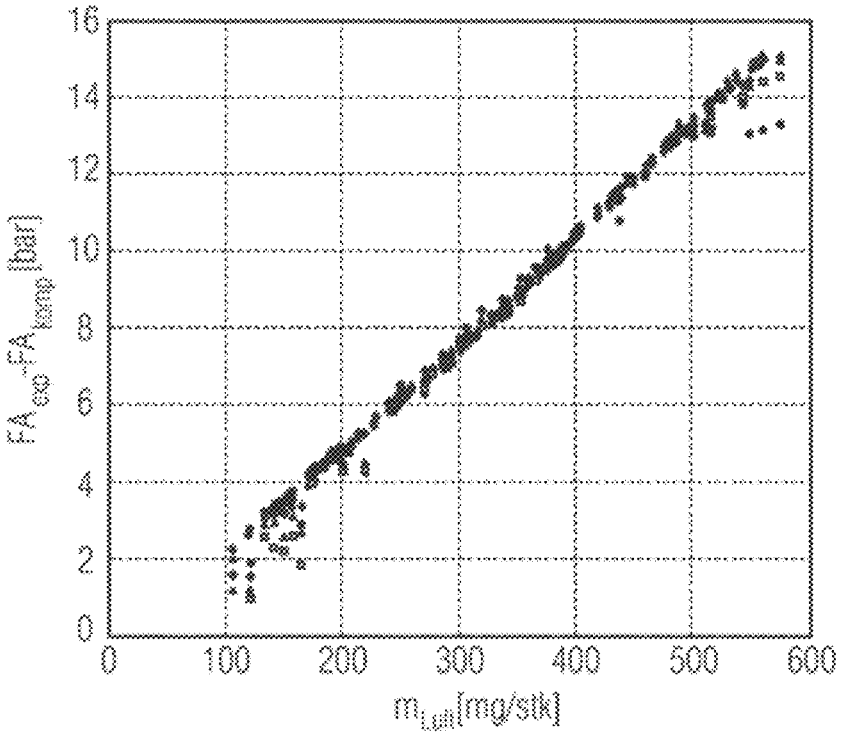
FIG. 4 shows a diagram in which a differential filling equivalent is illustrated plotted against an air mass profile, according to an example embodiment.

FIG. 4 shows an evaluation diagram in which the uncorrected differential filling equivalent $FA_{diff}$ is plotted against the air mass flow.

The air masses $m_{air}$ are plotted in FIG. 4 in mg (milligram) per stroke (mg per stroke (piston stroke)). The air masses $m_{air}$ relating to specific differential filling equivalents $FA_{diff}$ are determined individually, for example empirically, for each internal combustion engine. This can be determined, for example, on test rigs or in the laboratory.

At low load states such as, for example, in the idling state of the internal combustion engine, the accuracy of the air mass determination can be affected. As illustrated, for example, in FIG. 4, in the case of a differential filling equivalent $FA_{diff}$ of approximately 2 bar large fluctuations in air masses $m_{air}$ are measured.

This is due to the fact that in the case of a low load of the internal combustion engine the combustion in the expansion phase is slowed down. The state can then arise in which, in the case of a crank angle which is already in the second angle range, 100% of the fuel has not yet bunt. The complete combustion heat has therefore not yet been released, with the result that the measured pressure was measured when there was incomplete combustion heat. This in turn leads to a situation in which the air mass $m_{air}$ determined therefrom is not correctly determined.

In the event of the combustion not yet being completely ended in the second angle range, for example a correction calculation can be made. In this context, at the start of the second angle range of the expansion phase a percentage combustion proportion of complete combustion of a fuel in the cylinder is detected. The start of the second angle range is here at the end of the second angle range which is closest to the ignition TDC.

For example it is detected that at the start of the second angle range, at 40° crank angle in the example from FIG. 4, only 90% of the combustion has been concluded i.e. a complete reaction between the fuel $m_{fuel}$ and the air mass $m_{air}$ has not yet taken place. The heating profile or the quantity of heat of a combustion process as a function of the crank angle is calculated, for example, by means of the formula described above for the heating profile $\Delta Q_H$.

Figure 5:
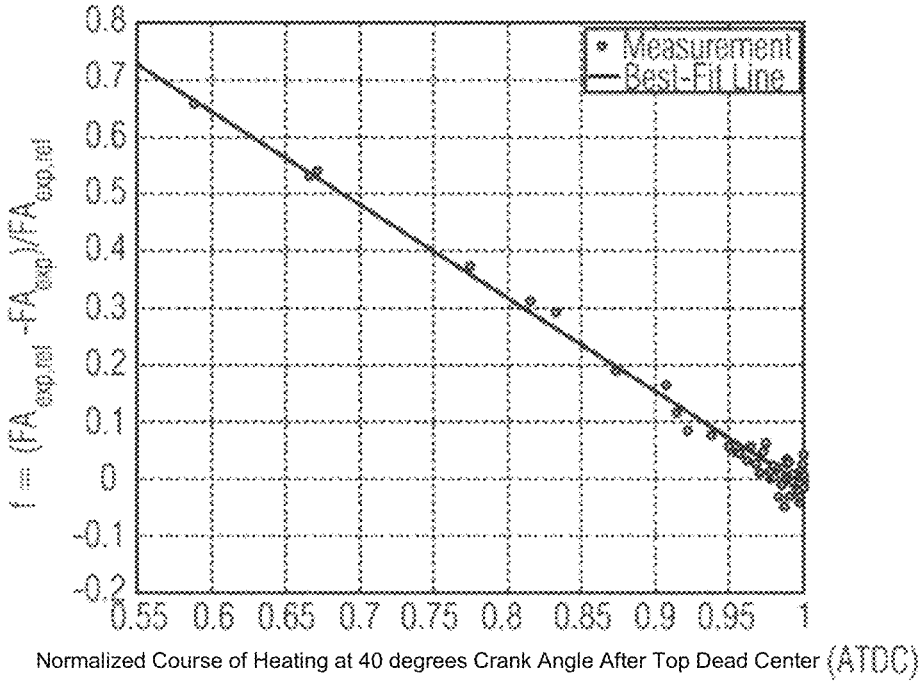
FIG. 5 shows a diagram in which a correction factor f is shown plotted against a normalized heating profile at 40° crank angle after the ignition TDC, according to an example embodiment.

As illustrated in FIG. 5, a complete combustion process can be standardized. This corresponds to what is referred to as a standardized cumulative heating profile $Q_H$. In FIG. 1, the standardized cumulative heating profile $Q_H$ is plotted on the x axis, where 1 represents complete combustion and 0 represents no combustion. The percentage combustion proportion, which corresponds to the heating profile $\Delta Q_H$, is specified between the values 0 and 1. A certain correction factor f is assigned to each combustion proportion of a complete combustion process. For example, the correction factor f=0.15 in the case when there is a 90% combustion proportion (see FIG. 5) The respective assignment of the values of the correction factor f is plotted in FIG. 5 on the Y axis. The values of the correction factor f relating to the individual combustion proportions of the combustion in the cylinder (X axis) can be determined empirically for any internal combustion engine and for any operating state of the internal combustion engine.

The correction factor f can be used to correct the second, uncorrected filling equivalent $FA_{uncor,exp}$, which is based on measured pressure values $p_{i,ref}$, $p_i$ at which the combustion was not yet 100% completed, with the result that a corrected, second reference filling equivalent $FA_{exp,Ref}$ can be determined. For the determination of the second corrected reference filling equivalent $FA_{exp,Ref}$ it is possible to use the following formula:

$$FA_{exp,Ref} = \frac{FA_{uncor,exp}}{1-F}$$

The first filling equivalent $FA_{comp}$ can in turn be subtracted from the corrected, second reference filling equivalent $FA_{exp,Ref}$, in order to obtain the corrected differential filling equivalent $FA_{diff}$.

Figure 6:
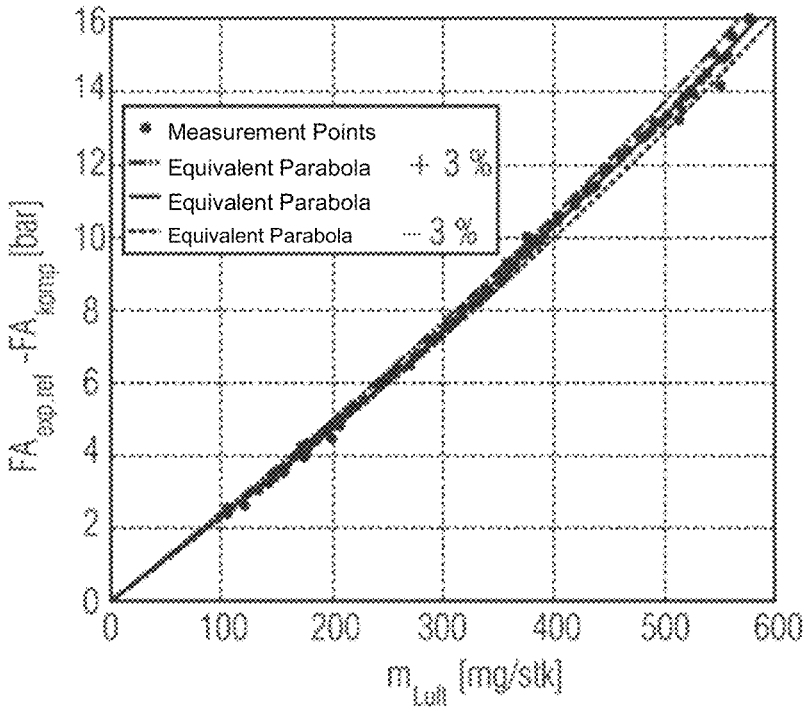
FIG. 6 shows a diagram in which a differential filling equivalent is illustrated plotted against an air mass flow after a combustion-profile-based correction, according to an example embodiment.

FIG. 6 shows that even in low load ranges of the internal combustion engine in which there is a small differential filling equivalent $FA_{diff}$ between 2 bar and 4 bar, it is possible to make a more precise statement about the air mass $m_{air}$ in the cylinder by means of the correction factor f. The variation of the values in the case of a small differential filling equivalent, which has been calculated by means of the second reference filling equivalent, is within a variation range from −3% to +3%.

In addition it is to be noted that "comprising" does not exclude other elements or steps and "a" or "an" does not exclude a plurality. In addition it is to be noted that features or steps which have been described with reference to one of the above exemplary embodiments can also be used in combination with other features or steps of other exemplary embodiments described above.

LIST OF REFERENCE SYMBOLS $\Delta\bar{p}_{comp}$ first average pressure difference $\Delta\bar{p}_{exp}$ second average pressure difference $p_{i,ref}$ reference pressure
$p_i$ measured pressure
$FA_{comp}$ first filling equivalent
$FA_{exp}$ second filling equivalent
$FA_{diff}$ differential filling equivalent
$FA_{uncor,exp}$ uncorrected, second filling equivalent
$FA_{exp,Ref}$ second reference filling equivalent
$m_{cyl}$ total gas mass
$m_{AGR}$ residual gas mass
$m_{fuel}$ fuel mass
$m_{air}$ air mass
f correction factor
$Q_H$ cumulative heating profile
$\Delta Q_H$ heating profile

What is claimed is:

1. A method for controlling combustion in a cylinder of an internal combustion engine, the method comprising:

determining a first filling equivalent during a compression phase of the cylinder, wherein the first filling equivalent corresponds to a first average pressure difference in a first angle range of a crank angle in the compression phase, determining a second filling equivalent during an expansion phase of the cylinder, wherein the second filling equivalent corresponds to a second average pressure difference in a second angle range of the crank angle of the expansion phase, forming a differential filling equivalent by subtracting the first filling equivalent from the second filling equivalent, determining the air mass in the cylinder based on the differential filling equivalent, calculating an amount of fuel to be injected into the cylinder to achieve a desired fuel/air mixture based on the determined air mass and injecting the calculated amount of fuel into the cylinder during a following combustion cycle, determining a percentage combustion proportion of a complete combustion of a fuel in the cylinder at the start of the second angle range of the expansion phase, and determining a correction factor indicative of the percentage combustion proportion, wherein the determination of the second filling equivalent comprises:

determining an uncorrected, second filling equivalent, and determining the second filling equivalent using the formula:

$$FA_{exp} = \frac{FA_{uncor,exp}}{1-f}$$

where $FA_{exp}$=second filling equivalent, $FA_{uncor,exp}$=uncorrected, second filling equivalent, and f=correction factor.

2. The method of claim 1, wherein:

the first angle range has a first angle interval from an ignition top dead center of the crank angle, the second angle range has a second angle interval from the ignition top dead center of the crank angle, and the first angle interval is the same size as the second angle interval.

3. The method of claim 1, wherein the first angle range is the same size as the second angle range.

4. The method of claim 1, wherein an inlet valve of the cylinder is closed in the first angle range.

5. A method for operating an internal combustion engine, the method comprising:

determining an air mass in a cylinder of an internal combustion engine by a process including:

determining a first filling equivalent during a compression phase of the cylinder, wherein the first filling equivalent corresponds to a first average pressure difference in a first angle range of a crank angle in the compression phase, determining a second filling equivalent during an expansion phase of the cylinder, wherein the second filling equivalent corresponds to a second average pressure difference in a second angle range of the crank angle of the expansion phase, forming a differential filling equivalent by subtracting the first filling equivalent from the second filling equivalent, and determining the air mass in the cylinder based on the differential filling equivalent, and calculating an amount of fuel added to the cylinder to reach a setpoint fuel/air ratio based on the determined air mass in the cylinder of the internal combustion engine and injecting the calculated amount of fuel into the cylinder during a following combustion cycle, wherein determining the air mass in a cylinder further comprises:

determining a percentage combustion proportion of a complete combustion of a fuel in the cylinder at the start of the second angle range of the expansion phase, and determining a correction factor indicative of the percentage combustion proportion, wherein the determination of the second filling equivalent comprises:

determining an uncorrected, second filling equivalent, and determining the second filling equivalent using the formula:

$$FA_{exp} = \frac{FA_{uncor,exp}}{1-f}$$

where $FA_{exp}$=second filling equivalent, $FA_{uncor,exp}$=uncorrected, second filling equivalent, and f=correction factor.

6. The method of claim 5, wherein:

the first angle range has a first angle interval from an ignition top dead center of the crank angle, the second angle range has a second angle interval from the ignition top dead center of the crank angle, and the first angle interval is the same size as the second angle interval.

7. The method of claim 5, wherein the first angle range is the same size as the second angle range.

8. The method of claim 5, wherein an inlet valve of the cylinder is closed in the first angle range.

9. A control unit for an internal combustion engine, the control unit comprising:

a processor; and computer instructions stored in non-transitory computer-readable media and executable by the processor to determine an air mass in a cylinder of the internal combustion engine by a process including:

determining a first filling equivalent during a compression phase of the cylinder, wherein the first filling equivalent corresponds to a first average pressure difference in a first angle range of a crank angle in the compression phase, determining a second filling equivalent during an expansion phase of the cylinder, wherein the second filling equivalent corresponds to a second average pressure difference in a second angle range of the crank angle of the expansion phase, forming a differential filling equivalent by subtracting the first filling equivalent from the second filling equivalent, determining the air mass in the cylinder based on the differential filling equivalent, calculating an amount of fuel to be injected into the cylinder to achieve a desired fuel/air mixture based on the determined air mass and injecting the calculated amount of fuel into the cylinder during a following combustion cycle, determining a percentage combustion proportion of a complete combustion of a fuel in the cylinder at the start of the second angle range of the expansion phase, and determining a correction factor indicative of the percentage combustion proportion, wherein the determination of the second filling equivalent comprises:

determining an uncorrected, second filling equivalent, and determining the second filling equivalent using the formula:

$$FA_{exp} = \frac{FA_{uncor,exp}}{1 - f}$$

where $FA_{exp}$=second filling equivalent, $FA_{uncor,exp}$=uncorrected, second filling equivalent, and f=correction factor.

10. The control unit of claim 9, wherein:

the first angle range has a first angle interval from an ignition top dead center of the crank angle, the second angle range has a second angle interval from the ignition top dead center of the crank angle, and the first angle interval is the same size as the second angle interval.

11. The control unit of claim 9, wherein the first angle range is the same size as the second angle range.

12. The control unit of claim 9, wherein an inlet valve of the cylinder is closed in the first angle range.

* * * * *